United States Patent [19]

Sauer

[11] 4,178,493

[45] Dec. 11, 1979

[54] PUSHBUTTON SWITCH WITH COLLAR

[75] Inventor: Heinrich Sauer, Amberg, Fed. Rep. of Germany

[73] Assignee: Siemens Aktiengesellschaft, Munich, Fed. Rep. of Germany

[21] Appl. No.: 970,216

[22] Filed: Dec. 18, 1978

[30] Foreign Application Priority Data

Jan. 5, 1978 [DE] Fed. Rep. of Germany ..... 2800492

[51] Int. Cl.[2] ..... H01H 3/12; H01H 13/04; H01H 9/00

[52] U.S. Cl. ..... 200/159 R; 200/295; 200/296; 200/314

[58] Field of Search ..... 200/295, 159 R, 293, 200/294, 296, 310, 314, 340

[56] References Cited

U.S. PATENT DOCUMENTS

| | | | |
|---|---|---|---|
| 2,883,496 | 4/1959 | White | 200/159 R X |
| 3,175,065 | 3/1965 | Strader | 200/159 R |
| 3,437,775 | 4/1969 | Piber | 200/314 |
| 3,740,501 | 6/1973 | Kiessling et al. | 200/159 R X |
| 3,984,797 | 10/1976 | Rayburn | 200/314 X |

*Primary Examiner*—Steven M. Pollard
*Attorney, Agent, or Firm*—Kenyon & Kenyon

[57] ABSTRACT

In an arrangement for front mounting of pushbutton switching devices by means of a front ring screwed by means of its internal thread onto an external thread of a collar, the diameter of the disc shaped pushbutton is larger than the diameter of the external thread of the collar. The front ring has inward protruding extensions and the pushbutton itself has cut-outs at its circumference corresponding to the extensions.

The pushbutton has a large actuating area without increase in the thread diameter.

3 Claims, 5 Drawing Figures

PUSHBUTTON SWITCH WITH COLLAR

BACKGROUND OF THE INVENTION (a) Field of the Invention

This invention relates to a structure for the front mounting of pushbutton switching devices by means of a front ring screwed onto an external thread of the collar.

(b) Description of the Prior Art

In command switches of the type mentioned above (German Petty Pat. No. 77 12 781), the diameter of the pushbutton is always smaller than the external screw thread of the collar onto which the front ring is screwed for front mounting. This means a loss of actuating area. It is an object of the invention to provide a pushbutton or command switch, the pushbutton actuating area of which is increased over known arrangements for front mounting.

SUMMARY OF THE INVENTION

This is achieved in the apparatus of the invention by providing a disc shaped pushbutton having a diameter larger than that of the external screw thread and a front ring which has inward protruding extensions and an internal thread matched to the external thread; the pushbutton has, at its circumference, cutouts corresponding to the extensions. The cutouts can be made substantially invisible by covering them with elastically resilient skins or tabs.

It is a feature of the invention that, should the torque for fastening the device by means of the front ring be insufficient, the extensions and the cutouts may advantageously be made in the manner of serrations.

DETAILED DESCRIPTION OF THE INVENTION

Figure 1:
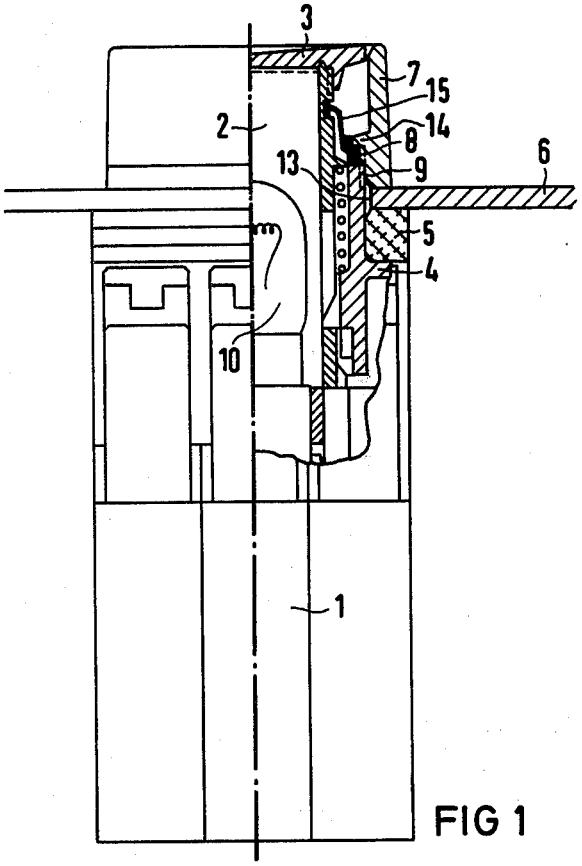
FIG. 1 shows a side view, in partial cross-section, of a pushbutton switching device in accordance with the teachings of the invention, fastened at a mounting wall.

The pushbutton switching device shown in FIG. 1 consists of the switching elements 1, the actuating member 2 carrying the pushbutton 3 and the collar 4, which is connected to the mounting plate 6 by means of the front ring 7 and gasket or seal 5. The internal thread 8 of the front ring 7 engages the external thread 9 of the collar 4. The pushbutton 3 can be displaced within the front ring 7. It is transparent and permits one to recognize the light indicator 10 in the interior of the actuating member 2.

Figure 2:
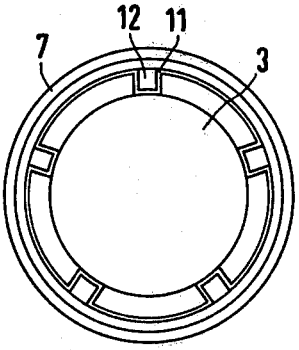
FIG. 2 is a top view of the pushbutton of FIG. 1, showing the front ring.

As shown in FIG. 2, the pushbutton has cutouts 11 in its circumference into which extensions 12 of the front ring 7 protrude. This makes it possible, after the switching device has been pushed from the rear of the mounting plate 6 through the mounting hole 13, to place the front ring 7 over the pushbutton 3, although the outside diameter of the pushbutton 3 is larger than the external thread 9 of collar 4. The pushbutton 3 is preferably connected rigidly to the actuating member 2. However, it can also be detachably connected to the actuating member so that different pushbutton colors can be supplied without having to stock separate actuating members. Preferably, however, the pushbuttons are shipped by the supplier connected to the actuating member, so as to simplify installation.

The extensions 12 which carry internal threads 8 have projections 14 which press a diaphragm seal 15 against the collar 4. In this case the size of the cutouts 11 is determined by the dimensions of the projections 14.

Figure 3:
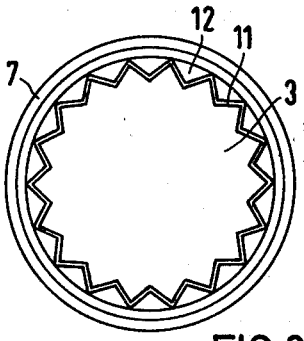
FIG. 3 is a top view of an embodiment with a serrated pushbutton.
Figure 4:
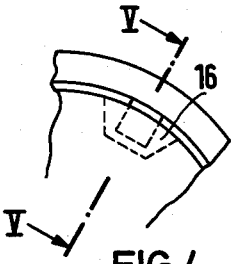
FIGS. 4 and 5 show partial top and side views of an embodiment having a skin is extended over the cutouts.
Figure 5:
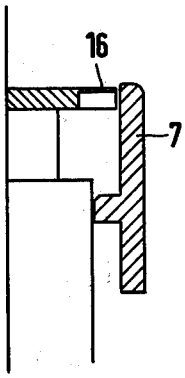

In the embodiment of the invention shown in FIG. 3, the cutouts 11 and the extensions 12 are made in the form of serrations. This increases the available area for the thread 8 and provides a different appearance. If the cutouts 11 in the pushbutton switch of FIGS. 1 and 2 are covered by skins 16 which are elastically resilient (FIGS. 4 and 5), the structure utilized can hardly be recognized from the outside. Instead of the skins, tab-like extensions of the plastic can be provided which make it impossible to see into the cutouts 11 in the pushbutton 3.

What is claimed is:

1. In a front mounted pushbutton switching device mounted by means of a front ring screwed onto an external thread of a collar, the improvement comprising a disc shaped pushbutton having a diameter larger than that of the external mounting thread, the front ring having inward projecting extensions with an internal thread matched to the external thread, and the pushbutton having cutouts corresponding to the extensions at its circumference.

2. The pushbutton switch of claim 1 having the further improvement that the cutouts are covered up by elastically resilient skins or tabs.

3. The pushbutton switch of claims 1 or 2, in which the extensions and cutouts are made in the manner of serrations.

* * * * *